US009390824B2

(12) United States Patent
Hofmann

(10) Patent No.: US 9,390,824 B2
(45) Date of Patent: Jul. 12, 2016

(54) CHROMATIC ENERGY FILTER

(75) Inventor: Ingo Hofmann, Dieburg (DE)

(73) Assignee: GSI HELMHOLTZZENTRUM FUER SCHWERIONENFORSCHUNG GMBH, Darmstadt (DE)

( * ) Notice: Subject to any disclaimer, the term of this patent is extended or adjusted under 35 U.S.C. 154(b) by 0 days.

(21) Appl. No.: 13/993,377

(22) PCT Filed: Dec. 9, 2011

(86) PCT No.: PCT/EP2011/072313
§ 371 (c)(1),
(2), (4) Date: Jun. 12, 2013

(87) PCT Pub. No.: WO2012/080118
PCT Pub. Date: Jun. 21, 2012

(65) Prior Publication Data

US 2013/0256556 A1 Oct. 3, 2013

(30) Foreign Application Priority Data

Dec. 13, 2010 (DE) ..... 10 2010 061 178

(51) Int. Cl.
*H01J 3/14* (2006.01)
*G21K 1/093* (2006.01)
*G21K 1/10* (2006.01)

(52) U.S. Cl.
CPC . *G21K 1/093* (2013.01); *G21K 1/10* (2013.01)

(58) Field of Classification Search
None
See application file for complete search history.

(56) References Cited

U.S. PATENT DOCUMENTS 4,551,625 A * 11/1985 Lischke ..... H01J 37/05 250/310
5,198,674 A * 3/1993 Underwood ..... H01J 49/30 250/396 ML
6,503,671 B1 * 1/2003 Nakajima ..... B82Y 10/00 430/296
6,639,227 B1 * 10/2003 Glavish ..... H01J 37/05 250/296
7,223,983 B2 * 5/2007 Kawasaki ..... H01J 37/1478 250/310
7,321,604 B2 * 1/2008 Umstadter ..... H01S 3/30 372/2
7,335,894 B2 * 2/2008 Frosien ..... H01J 37/05 250/310
7,642,521 B2 * 1/2010 Willi ..... G21K 1/087 250/396 ML
2002/0090194 A1 * 7/2002 Tajima ..... H05H 15/00 385/147
2003/0183774 A1 * 10/2003 Tajima ..... H05H 7/16 250/423 P
2004/0188608 A1 * 9/2004 Kaneyama ..... H01J 37/05 250/305
2005/0029471 A1 * 2/2005 Kraft ..... G21K 1/10 250/492.1

(Continued)

FOREIGN PATENT DOCUMENTS

DE EP 1482519 A2 * 12/2004 ..... G21K 1/04
DE 10 2005 012059 A1 9/2006

(Continued)

OTHER PUBLICATIONS

Fritzler et al: "Proton beams generated with high-intensity lasers: Applications to medical isotope production", Applied Physics Letters, AIP, American Institute of Physics, Melville, NY, US, vol. 83, No. 15, Oct. 13, 2003, pp. 3039-3041, XP012035369, ISSN: 0003-6951, DOI: 10.1063/1.1616661 abstract.

*Primary Examiner* — Andrew Smyth
(74) *Attorney, Agent, or Firm* — Leydig, Voit & Mayer, Ltd.

(57) ABSTRACT

An energy filter device for radiation includes at least one focusing device configured as an energy-dependent focusing device and at least one beam separating device.

20 Claims, 4 Drawing Sheets

(56) References Cited

U.S. PATENT DOCUMENTS

2005/0147147 A1* 7/2005 Umstadter ..... H01S 3/30 372/73
2005/0167610 A1* 8/2005 Tajima ..... H05H 15/00 250/423 P
2006/0151711 A1* 7/2006 Frosien ..... H01J 37/05 250/396 ML
2006/0165062 A1* 7/2006 Nishida ..... H04L 29/06 370/352
2006/0219915 A1* 10/2006 Degenhardt ..... H01J 37/28 250/311
2006/0226361 A1* 10/2006 Frosien ..... G01R 31/305 250/310
2007/0218646 A1* 9/2007 Hitosugi ..... C03C 17/2456 438/449
2008/0191143 A1* 8/2008 Willi ..... G21K 1/087 250/396 ML
2010/0258719 A1* 10/2010 Benner ..... H01J 37/09 250/306
2010/0290575 A1* 11/2010 Rosenthal ..... H01J 27/18 376/112
2013/0126727 A1* 5/2013 Jozwiak ..... H01J 49/446 250/305

FOREIGN PATENT DOCUMENTS

DE 102005012059 * 9/2006 ..... G21K 1/087
DE EP 1482519 A3 * 5/2007 ..... G21K 1/04
DE EP 1482519 B1 * 12/2010 ..... G21K 1/04
EP 1482519 A2 12/2004
JP 11096955 A * 4/1999
JP 2004079510 A * 3/2004
JP 2006190653 A * 7/2006

* cited by examiner

CHROMATIC ENERGY FILTER

CROSS REFERENCE TO RELATED APPLICATIONS

This application is a U.S. National Phase application under 35 U.S.C. §371 of International Application No. PCT/EP2011/072313, filed on Dec. 9, 2011, and claims benefit to German Patent Application No. DE 10 2010 061 178.6, filed on Dec. 13, 2010. The International Application was published in German on Jun. 21, 2012, as WO 2012/080118 A1 under PCT Article 21 (2).

FIELD

The invention relates to an energy filter device for radiation, a particle radiation source, a method for the energy-dependent filtering of radiation, and the use of an energy-dependent focusing device for the energy-dependent filtering of radiation.

BACKGROUND

In the technical realm, there are many areas where there is sometimes a need to allow only certain components of a signal to pass through, but to split other signal components from the signal. Such devices are generally referred to as filters.

For example, in the case of input radiation that has a wide energy spectrum, it is sometimes necessary to allow only a certain energy range to pass through the filter, but to split off other energy ranges from the radiation that is to be processed (to be "filtered"). Such a filter device for radiation is typically referred to as an energy filter. Sometimes, the term frequency filter is used, whereby the so-called de Broglie relation can be employed to convert the energy of radiation into a frequency and vice versa. This relates not only to photon radiation but also and especially to particle radiation (also called corpuscular radiation).

Especially in particle accelerator technology, there is regularly a need to allow certain energy ranges to pass through an energy filter, while other energy ranges have to be filtered out by the filter. This involves not only uncharged particles but also charged particles (for example, electrons, protons and heavy ions, or in very general terms, charged and/or uncharged leptons and/or hadrons). In the meantime, particle accelerator technology has developed beyond pure (basic) research and is now used routinely in a number of fields. Purely by way of example, mention should be made here of electron welding techniques, but especially of the medical use of particle radiation, for instance, in cancer treatment.

Particularly in cancer therapy, ions, specifically heavy ions (for instance, carbon ions, oxygen ions, neon ions, nitrogen ions and the like) have proven to be very advantageous since such heavy ions have a pronounced Bragg peak, thus making it not only possible to deposit a specific radiation dose in a way that is focused in the x-y-direction, but also to limit the dose deposition to a certain depth range (z-direction).

Up until now, such particle beams (that is to say, in particular, heavy ion particle beams) have been generated for use typically with linear accelerators, particle cyclotrons and/or particle synchrotrons. However, the requirements in terms of the equipment needed for such particle synchrotrons are quite extensive so that efforts are being made to cut back on these requirements. Moreover, particle beams that are generated by linear accelerators, cyclotrons and/or synchrotrons entail certain physical drawbacks. Furthermore, such accelerators are very large and not very energy-efficient in relation to the number of particles generated, which results in correspondingly high installation and operating costs.

A proposal for an alternative way to generate particle beams, in particular, heavy ion particle beams, consists of generating the particle beams using lasers. In this process, a high-energy laser is applied to a thin film. The actual acceleration procedure of the ions takes place directly behind the thin film, which is irradiated on the front with the laser light at an extremely high power density (typically in the range from 1021 Watt/cm2). The thermal energy thus deposited into the film brings about the acceleration of the ions due to thermal kinetic effects.

In particular, with this proposed accelerator concept—in contrast to the properties of particle synchrotrons or linear accelerators—ions occur that are released from an essentially punctiform initial position towards the outside in the shape of a bundle. Moreover, a broad spectrum of very different particle energies occur. Thus, it is desirable to focus the radiation bundle that is fanned open angularly and moreover, to filter out the useable energies. It would be especially preferable if the filtering could be variable, so that a depth modulation can be achieved in a simple manner when material is irradiated (for example, the tissue of a patient).

It has been found that, as a rule, existing concepts for the energy filtering of radiation from particle radiation entail considerable deficits, especially when they are used together with laser target film particle accelerators.

SUMMARY

In an embodiment, the present invention provides an energy filter device for radiation includes at least one focusing device configured as an energy-dependent focusing device, and at least one beam separating device.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
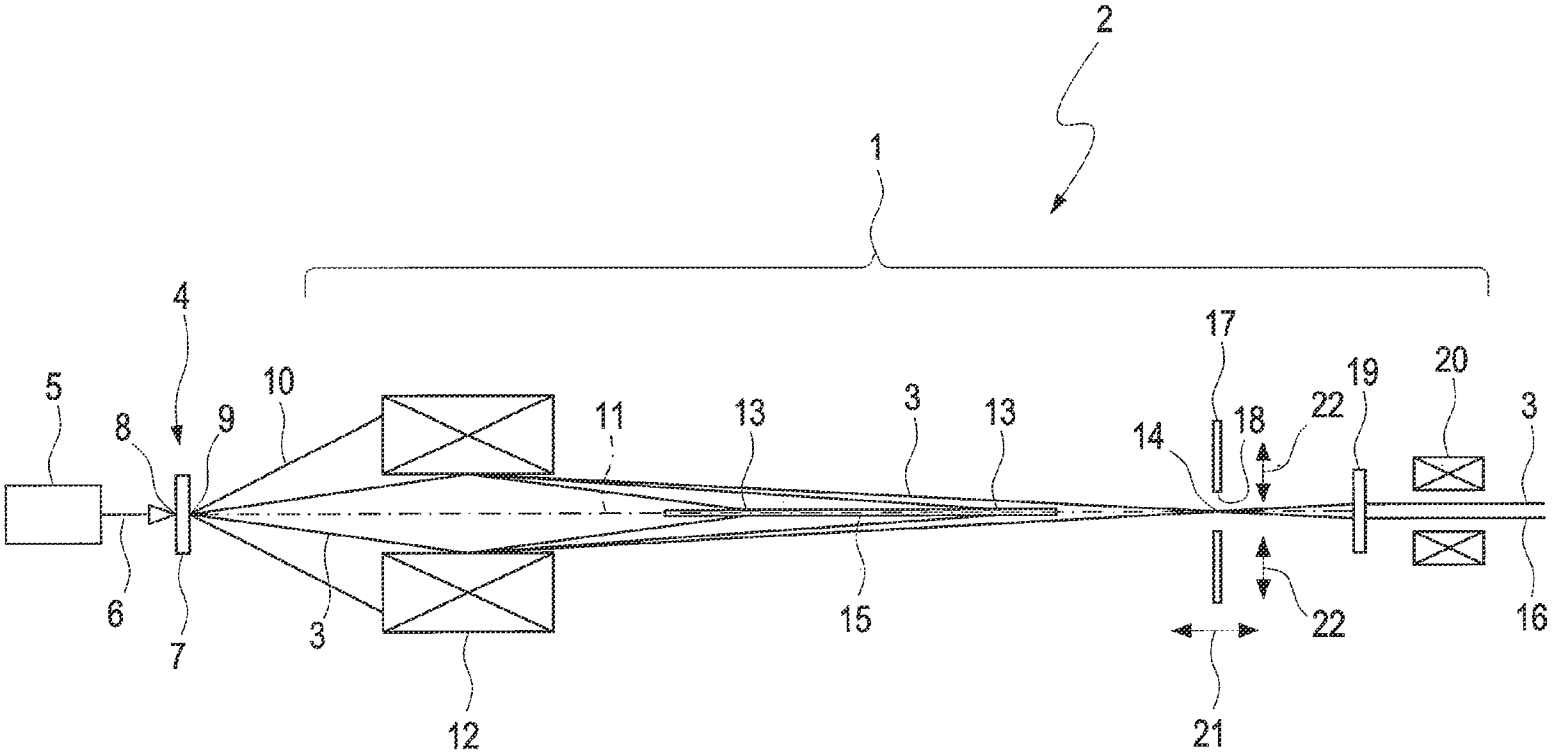
FIG. 1 shows a first embodiment for a particle beam source in a schematic view.

An aspect of the invention is to provide an energy filter device for radiation, especially an energy filter device for particle radiation, preferably of charged particles, which is improved in comparison to prior-art energy filter devices. Another aspect of the invention is to provide a particle radiation source, especially a particle radiation source for supplying particle radiation having certain energies, which is improved in comparison to prior-art particle radiation sources. Another aspect of the invention is to provide a method for the energy-dependent filtering of radiation, especially of particle radiation, preferably of charged particles, which is improved in comparison to prior-art methods.

In an embodiment, the present invention provides an energy filter device for radiation comprising at least one focusing device as well as at least one beam separating device in such a way that the at least one focusing device is configured as an energy-dependent focusing device. The energy filter device for radiation can especially be an energy filter device for particle radiation. The particle radiation can preferably be charged particles. The particles can be especially charged and/or uncharged particles such as, for example, charged/uncharged leptons and/or charged/uncharged hadrons. Purely by way of example, mention should be made here of electrons, protons, mesons, pions, neutrinos, antiprotons, ions and/or molecules, for example, ions of hydrogen, helium, nitrogen, oxygen, carbon, neon. Of course, it is also possible to use a mixture of different ions and/or other particles, especially of the above-mentioned particles. The energy filter device can carry out the filtering function in any desired manner. In particular, it is conceivable that only ions within a certain energy interval are allowed to pass through. Here, the energy interval can be closed on two sides or else closed only on one side (for instance, in such a way that only particles up to a certain energy, or conversely, particles above a certain energy are allowed to pass through). It is also possible that not only ions within a certain energy range are allowed to pass through, but conversely, that ions within a certain energy range are filtered out, while ions in all other particle energies are allowed to pass through. Of course, the filtering does not have to be limited to a single range, but rather, several transmittance windows and/or blocking windows can be provided. Moreover, the filter curves can have essentially any desired "shape". Thus, for instance, they can be rectangular filter curves that, if applicable, are "flattened" and/or "blurred" on one side and/or on two sides. They can also be a Gaussian filter curve. In particular, they can be a Gaussian filter curve with a "flat middle piece" ("flat-top"). Mixed forms of different filter curves are, of course, also conceivable. The term focusing device refers especially to essentially any means that, at least at times and/or at least in certain areas, allow a certain convergence (especially in the sense of a collecting lens). In particular, the focusing devices can make it possible to convert at least a certain part of a radiation consisting especially of ions and being emitted by a punctiform source "into a parallel beam bundle", and/or to concentrate a "parallel beam bundle" onto a focal point (or onto several focal points). This especially encompasses the possibility that the radiation being emitted by a punctiform source is diffracted in such a way that it is bundles onto another focal point (or onto several focal points). As already mentioned, this bundling effect does not necessarily have to be "complete", but rather, it can especially be limited to certain energy ranges, to certain local areas of the focusing device and the like. On the one hand, this "limitation" includes the possibility that, for example, the focal point (or several focal points) "migrate" for different energies and/or for different spatial areas, and/or that, in certain spatial areas and/or at certain energies, no focusing effect is possible. The term beam separating device refers to any device that separates the radiation in a certain manner. This can be a "splitting process" of the kind in which the two (or more) partial areas are directed in different directions. By the same token, it is also conceivable that the two (or more) partial areas are attenuated (damped; absorbed) to different extents (including the possibility that partial areas are virtually not attenuated, while other partial areas are attenuated virtually completely or to a negligible level). Of course, another kind of treatment is also conceivable such as, for instance, the introduction of a certain frequency range into a frequency multiplier range or the like. The term energy-dependent focusing device especially means that the focusing for different energies is carried out in different ways. As put forward in the explanations above, this can be understood to mean that, for example, focusing for different energies is carried out at different places (optionally also at several places). It is also possible that, particularly for certain energy ranges, no focusing takes place, whereas for other energy ranges, such focusing takes place or can take place. Through the proposed "combination effect" of focusing on the one hand, and energy-dependent focusing on the other hand, the radiation can be focused and a filtering process can be carried out by utilizing the same components (or by utilizing some partial components—which might be configured jointly). Consequently, on the one hand, the total resources required for the energy filter device can be reduced. On the other hand, due to the smaller number of components, energy can be saved and typical (undesired) imaging errors can be diminished. Moreover, as a rule, it might be possible to markedly reduce the total size of the device. The energy-dependent focusing effect of the energy-dependent focusing device can be referred to by the term "chromatic focusing" or "chromatic aberration", analogously to the realm of optics. The already mentioned "combination effect" proves to be especially advantageous, particularly in conjunction with components for which both "effects" have to be used. Purely by way of example, mention should be made here of laser target particle accelerators for which, on the one hand, there is a need to focus the beam-shaped particle radiation being emitted by a punctiform source, particularly in order to achieve an effective yield of the radiation generated by the laser target particle accelerator (and thus in order to achieve an acceptably high emittance on the part of the system), and on the other hand, there is also a need to carry out an energy filtering process, since, for functional reasons, an extremely wide energy scatter is present in such laser target accelerators.

It is proposed to configure the energy filter device with precisely one and/or with precisely two beam separating devices. Preliminary calculations have shown that, surprisingly, in the case of a filter that only allows energies above or below a certain limit energy to pass (whereby the transition at the limit energy can be "fluid") as well as in the case of energy filter devices that allow one or more energy ranges to pass through (or block them), just one single, optionally two, beam separating devices are already fully adequate for the objective that is to be achieved. Due to the small number of beam separating devices, the complexity, size and costs of the energy filter device can be reduced. Moreover, as a rule, it is also the case that a smaller number of components (especially of beam separating devices) typically leads to an improved output quality of the filtered radiation, since typically fewer error parameters enter into the "processing" of the radiation. Accordingly, such a structure can prove to be especially advantageous.

Moreover, in the energy filter device, it is proposed that, at least one variable beam separating device and/or at least one movably arranged beam separating device is/are provided. If the beam separating device is moveable, this can particularly mean that it is movable in the direction of the "optical axis" of the energy filter device. This is especially advantageous since such a lengthwise movement permits different "focusing points" to be reached, as a result of which different energies or energy ranges can be selected. Consequently, the energy filter device also allows a relatively fast and uncomplicated variation of the energy. Such an energy variation is needed, for example, during depth-modulated scanning methods during material processing and/or during medical applications (for example, tumor treatment). However, it is also possible that the lengthwise adjustment is used, for example, so that variations during the actuation of the focusing device (e.g. current fluctuations) can be at least partially compensated for. This, too, can prove to be advantageous. In addition or as an alternative, of course, a movement of the beam separating device in other directions (that is to say, especially in the x-direction or in the y-direction) is also possible, whereby rotations of the beam separating device might also be advantageous. In the case of a variable beam separating device, the length and/or the diameter of the beam separating device can advantageously be changed (especially if it has a beam separating effect due to the "mechanical shape"). For example, an enlargement of the aperture (of the diameter) of a beam separating device can increase or decrease the size of the energy range that is allowed to pass through the energy filter device. In addition or as an alternative, however, it is also conceivable that a movement of the beam separating device and/or a change of another component such as especially the focusing device can be at least partially compensated for by means of such an increase or decrease in the size of the aperture (or by means of some other change) of the beam separating device. Such a structure can also markedly increase the flexibility and usability of the energy filter device. Particularly if a plurality of variable and/or movably arranged beam separating devices is provided, then, by changing at least two beam separating devices in a coordinated manner, a change can be made in the radiation fraction (number of particles) allowed to pass through the energy filter device. This is especially possible without necessarily (essentially) changing the energy selection. Normally, for example, a simultaneous, coordinated narrowing of two beam separating devices (for example, pinhole diaphragms and/or other apertures) brings about a reduction of the number of particles allowed to pass through. Here, it is possible that a change in the output divergence (especially by reducing the initial divergence) and/or a change in the beam spot size can occur at the output of the energy filter device (and thus, if applicable, at the actual target volume of a body that is to be irradiated). However, such effects can optionally be countered by adding and/or adapting other components (such as, for instance, a diffusion film).

Moreover, in the energy filter device, it is proposed that at least one focusing device is configured as a magnetic field generating device, at least at times and/or at least in certain areas, and in particular, it has at least one, preferably a plurality of magnetic dipole devices and/or at least one, preferably a plurality of magnetic quadrupole devices, especially preferably a doublet and/or a triplet and/or a quadruplet and/or a multiplet of quadrupole devices, and/or at least one, preferably a plurality of solenoid devices, and/or at least one, preferably a plurality of Helmholtz coil devices, and/or at least one, preferably a plurality of superconductive magnetic field generating devices, and/or least one, preferably a plurality of normally conductive magnetic field generating devices. In particular, magnetic fields have proven to be especially advantageous for deflecting especially charged particles. Accordingly, the use of magnetic field generating devices has proven to be advantageous. The explicitly cited devices have also proven to be suitable and, as a rule, also advantageous, for deflecting especially charged particles. In particular, the use of quadrupole devices (especially a plurality of quadrupole devices) is advantageous when relatively small angular areas are to be focused. Solenoid devices have proven to be very advantageous, especially when relatively large angular ranges are to be focused. Solenoid devices are typically elongated coil devices, often in the form of a kind of air-cored coil that is "bombarded" in the lengthwise coil direction by the particle beam. As a rule, such solenoids also have good focusing properties when used on their own. Moreover, the interaction of especially charged particles with magnetic fields are generally energy-dependent, particularly when the flight direction of the particles and the direction of the magnetic field are appropriately arranged with respect to each other. In this manner, magnetic field generating devices, especially the above-mentioned magnetic field generating devices, can be used to configure energy-dependent focusing devices in a very simple manner. The use of superconductive coils can prove to be very advantageous if relatively strong magnetic fields are to be generated, especially if they are supposed to be relatively constant. In contrast, normally conductive magnetic field generating devices are very advantageous when the magnetic fields to be generated are supposed to fluctuate over an especially wide range. Of course, a combination of superconductive and normally conductive magnetic field generating devices is also conceivable, especially in such a way that a strong magnetic field (that is typically generated by the superconductive magnetic field generating device) is superimposed by a smaller, time-variable magnetic field (that is typically generated by a normally conductive magnetic field generating device) as a result of which it is "modulated".

Moreover, in the energy filter device, it can prove to be advantageous if a plurality of focusing devices and/or a plurality of magnetic field generating devices are provided, whereby at least at times and/or at least in certain areas, the focusing devices and/or the magnetic field generating devices have a focusing effect in different directions. When a plurality of focusing devices and/or magnetic field generating devices are used, it is optionally possible to configure an individual focusing device or a magnetic field generating device to be smaller or weaker, and nevertheless to achieve the desired overall effect in combination with other focusing devices or magnetic field generating devices. Moreover, through the use of a plurality of focusing devices and/or magnetic field generating devices (especially when quadrupole devices are used), a deflection in different directions can be achieved, which especially can also have a focusing effect. In this manner, for example, the entire x-y plane can be focused onto one point (optionally also onto a straight line or the like), so that the total acceptance of the device (or the total emittance of the ultimately generated beam containing particles, preferably ions) can be markedly increased. As already mentioned, the focusing here does not necessarily have to be symmetrical (especially rotation-symmetrical). Rather, for example, an n-fold symmetry can be visualized, especially wherein n=2, 3, 4, 5, 6, 7, 8 and the like. Fundamentally, however, it is also possible to configure the energy filter device in such a way that it only has a focusing effect in one single direction.

Moreover, in the energy filter device, it is preferred if the energy-dependence of at least one focusing device is expressed as a movement of the focal point, especially as a movement of the focal point in the lengthwise direction, at least at times and/or at least partially and/or at least in certain areas. Such a movement of the focal point is especially advantageous when beam separating devices are used, since they can be designed in a relatively simple way so as to be "spatially resolving" (or "spatially dependent"). The total resources required for the energy filter device can then be particularly simple. In particular, it is possible, for example, for the beam separating device to be configured as a simple delimitation wall having a delimitation edge. This is correspondingly simple.

Moreover, in the energy filter device, it can prove to be advantageous if at least one beam separating device is configured in certain sections as an absorber device, at least in certain areas and/or at least partially. Experience has shown that, as a rule, it is not practical to use the energy ranges that are to be separated by the energy filter device "on site". Consequently, an absorption ("elimination") of the energy ranges in question is particularly advantageous, and moreover, as a rule, also very easy to carry out (for example, by simply providing a compact, radiopaque material). Such an absorption can especially prove to be advantageous, particularly in conjunction with a controlled change in the number of particles allowed to pass through the energy filter device.

Furthermore, in the energy filter device, it has proven to be especially advantageous if the at least one beam separating device is configured as a diaphragm device at least in certain areas and/or at least partially, and/or as an axial absorber device at least in certain areas and/or at least partially, whereby the at least one diaphragm device and/or the at least one axial absorber device are provided with oblique beam-optimized surfaces, at least at times and/or at least in certain areas, and/or have a frustoconical surface and/or a double frustoconical surface at least at times and/or at least in certain areas. As far as the diaphragm device is concerned, in the simplest case, it can be in the form of a hole that is made of a compact material. It is not necessary for the size of the hole to be variable, but it is advantageous if this is made possible by means of suitable design measures. An axial absorber device can especially be configured in the form of a kind of rod that is especially arranged in the middle of the optical axis. Preferably, the rod can have a frustoconical shape. The rod (with the frustoconical shape) can especially be used to provide an (additional) attenuation for energy ranges that are too high or too low. However, it can often prove to be completely adequate to provide one single diaphragm device in order to allow a certain energy fraction to pass through and to attenuate the rest. Merely for the sake of completeness, it should be pointed out that, of course, completely different principles and/or shapes can be utilized. The term "oblique beam-optimized surface" refers especially to a surface that is arranged at an angle and/or in a position such that a particle beam that is just barely permissible (especially a maximum value and/or a minimum value of the particle energy) runs in a kind of "parallel incidence" along the surface in question, at least in certain areas. This has the advantage that, if the particle beam exceeds the permissible limit value, it has to pass through the material over an especially long distance, and is attenuated to a commensurate extent. With such a configuration, as a rule, an especially sharp separation is possible. In addition or as an alternative, however, such a configuration can also especially effectively prevent "impurities" due to secondary particles (for example, released photons, neutrons, electrons and the like). This is accordingly advantageous. As a rule, frustoconical and/or double frustoconical surfaces have proven to be especially suitable oblique beam-optimized surfaces. They can limit a solid body towards the outside, and they can limit a hollow body in a material block (optionally, also a combination thereof).

Moreover, it can be advantageous for the energy filter device to have at least one beam separating device that is configured as a direction-dependent beam separating device, especially as an angular direction-dependent beam separating device. This means that a different energy bandwidth can be separated and/or allowed to pass through (or attenuated) in different directions by means of the beam separating device. This is possible, for example, by means of beam separating devices that have a non-rotation-symmetrical effect or a non-rotation-symmetrical design. If the beam separating device is configured, for instance, as a diaphragm device, then such a direction-dependence can be configured in the form of a hole with several additional recesses facing radially outwards. For example, one, two, three, four, five, six, seven, eight, nine, ten or even more additional recesses preferably facing radially outwards are conceivable. Such a direction-dependence (which, as a rule, can also be partially eliminated again by downstream components, especially by one or more downstream diffusion films) makes it possible that not only a direction-dependence is created, but (ultimately) in addition or as an alternative, an additional energy blurring can be achieved, which can also especially be configured in such a way that the desired energy distribution is achieved. In this context, mention should be made of a Gaussian energy distribution as a highly preferred energy distribution, whereby, however, other forms are also conceivable and, if applicable, can also be advantageous. A Gaussian superimposition, however, generally has the advantage, particularly in medical applications, that such a superimposition of several Gaussian curves within the scope of a scanning procedure (which especially also encompasses a deep scan) and the resultant superimposed radiation applications have proven to be advantageous.

Moreover, it can prove to be advantageous if the energy filter device comprises at least one upstream beam separating device that especially brings about a beam separation in terms of the spatial angle range of the radiation entering the energy filter device. For example, a (generally undesired) "bombardment" of particles of the focusing device (for example, a solenoid) and the like can be effectively prevented by such a beam separating device. In this manner, for instance, secondary particles such as electrons, neutrons and the like can be avoided. In certain cases, damage to the components in question, which would otherwise be "bombarded", can also be avoided.

Moreover, it is also advantageous if the energy filter device has at least one beam separating device, especially for outgoing radiation, that is preferably configured as a diffusion film device, and/or if the energy filter device is provided with at least one downstream focusing device, especially for the radiation exiting from the energy filter device. When a diffusion film device is used, undesired spatial distributions caused by the filtering process (which are especially non-symmetrical or non-rotation-symmetrical) and/or undesired "energy edges" are blurred. Depending on the configuration (especially in terms of the material and/or material thickness) of the diffusion film, the blurring can be configured to be of different degrees. Such a diffusion film device can especially be provided behind the last aperture of the energy filter device and/or at an adequate distance (typically several centimeters) in front of the last aperture of the energy filter device. By using an output focusing device, it is especially possible for the outgoing radiation to be rendered parallel, which is normally very advantageous, particularly if it has to be transported over a long distance.

Moreover, a particle radiation source is proposed that has at least one target means as well as an energy filter device having the above-mentioned construction. The particle radiation source can especially be a particle radiation source for providing particle radiation having certain energies. The target means (this can be, for example, a target film or the like) can especially be a laser target means, that is to say, a target means irradiated by a typically very strong laser. The resulting particle radiation source can then have the above-mentioned features, properties and advantages in an analogous manner. Of course, a refinement of the particle radiation source in the sense described above is also possible.

Moreover, a method for the energy-dependent filtering of radiation is proposed in which the radiation is split by using at least one energy-dependent focusing device and subsequently, radiation having a desired energy is separated by means of at least one beam separating device. This radiation can especially be particle radiation, whereby the particles can especially preferably be charged particles. The method analogously has the advantages, properties and features mentioned above in conjunction with the energy filter device. Moreover, the method can also be modified as put forward in the preceding description.

Finally, the use of an energy-dependent focusing device is proposed for the energy-dependent filtering of radiation, especially of particle radiation, preferably of charged particles, whereby the radiation is separated out using the energy-dependent focusing device and subsequently, radiation having a desired energy is split by means of at least one beam separating device. Through the proposed use, the above-mentioned properties, features and advantages can at least be achieved in an analogous manner. Moreover, the proposed use as put forward in the preceding description can at least be expanded or modified in an analogous manner.

In a schematic top view from the side, FIG. 1 shows of a particle beam source 2. The particle beam source 2 serves to generate a (heavy) ion particle beam (output beam 16; for example, of carbon ions) that can be used in a medical apparatus for irradiating tumors. In order to meet the relatively high requirements made by medical applications, the particles 3 of the output beam 16 emitted by the particle beam source 2 have to meet relatively high requirements. In particular, the emitted particle beam 16 has to be virtually parallel, that is to say it has to form a so-called "pencil beam" 16. Moreover, the particles 3 contained in the particle beam 16 must lie within a relatively narrowly delineated energy range.

The "classic" and currently most often used method for generating such a particle beam that is suitable for medical purposes makes use of linear accelerators, usually in combination with particle synchrotrons. Such installations, however, are relatively expensive, have high energy consumption, and also have a very large volume, especially a large volume that has to be shielded from the surroundings in terms of radiation, so as to avoid an environmental burden due to particle radiation (particularly neutron and/or radioactive radiation).

In contrast, the particle beam source 2 is based on a different acceleration principle, namely, so-called laser-induced particle acceleration. For this purpose, the actual accelerator stage 4 (shown on the left-hand side in FIG. 1) has a very strong high-power pulsed laser 5 that typically has a power density of approximately 1021 Watt/cm2. The thin laser beam 6 generated by the laser 5 is aimed at a target film 7. The laser beam 6 strikes the target film 7 in a small, essentially punctiform area (radiation impact spot 8). The actual, essentially likewise punctiform acceleration area 9 is on the side of the target film 7 opposite from the radiation impact spot 8, namely, directly adjacent to the target film 7. Due to the amount of energy introduced by the laser bombardment, extreme heating occurs in the accelerator area 9, so that a diverging beam bundle 10 is released in the essentially punctiform accelerator area 9. Here, the diverging beam bundle 10 is indicated by four lines drawn symmetrically with respect to the center axis 11. The diverging beam bundle has an essentially continuous intensity distribution that decreases as the angle to the center axis 11 increases. Aside from the widening of the angle of the generated beam bundle 10, the released particles 3 that are present in the beam bundle 10 have a great energy variation. At the above-mentioned laser power, for example, with protons, particle energies in the interval between 0 MeV and 250 MeV to 300 MeV can be expected.

In order to achieve the highest possible particle fluence (in other words, in order to "lose" as few of the generating particles as possible), the diverging beam bundle 10 is focused through a solenoid coil 12. In terms of the deflection properties of the employed solenoid 12, the latter resembles an optical collecting lens that has a strong chromatic imaging error (that is to say, a strong chromatic aberration). This means that particles 3 having different energies are focused at a different distance from the solenoid 12 (or from the target film 7) onto a focal point 13, 14. For the sake of illustration, FIG. 1 shows two focal points 13 of particles having the "wrong" energy (to put it more precisely, energy that is too low), as well as a focal point 14 for particles with the "right" energy.

As one can clearly see in FIG. 1, the particles 3 that converge in a "wrong" focal point meet in a focal point 13 that is located on (or in) the axially arranged, rod-shaped absorber 15. Accordingly, the low-energy particles 3 that correspond to this are attenuated by the rod-shaped absorber 15, and are thus "filtered out" of the output particle beam 16. A more advantageous embodiment is attained if the rod-shaped absorber 15 is conical in shape, and thus has an oblique beam-optimized shape.

Moreover, a pinhole diaphragm 17 is provided that has a round hole 18 arranged in the middle. Particles 3 that have the desired target energy are focused by the solenoid 12 in a focal point 14 that is situated in the middle of the round hole 18 of the pinhole diaphragm 17. The particles 3 in question (after having flown past the rod-shaped absorber 15) can thus pass through the round hole 18 of the pinhole diaphragm 17 essentially without being attenuated. The same applies to particles 3 that have an energy that diverges slightly from the target energy, since the round hole 18 has a certain size.

However, particles that are above the upper limit energy, for the most part, strike an area of the pinhole diaphragm 17 that is outside of the round hole 18. Accordingly, such high-energy particles 3 are attenuated by the pinhole diaphragm 17.

The particles 3 that pass through the pinhole diaphragm 17 (that is to say, particles with the "right" energy) are aimed behind the pinhole diaphragm 17 at a diffusion film 19. The latter typically consists of a plastic material and has a thickness of one to a few millimeters. The diffusion film 19 causes a blurring of the filter curve so that the edges of the filter curve are less steep. Moreover, the diffusion film 19 also brings about a certain, typically relatively small, angular scattering of the individual partial particle beams 3. Since the particles that leave the diffusion film 19 have a certain (although relatively small) angular scattering, another solenoid 20 is installed downstream from the energy filter 1, and this solenoid 20 forms a thin, parallel particle beam 16 from the slightly diverging particle beam bundle 3. In addition, a movement of the pinhole diaphragm 17 along the center axis 11 of the energy filter 1 is provided (this can be achieved, for example, by a linear motor or by a stepping motor using a toothed rack). The movement of the pinhole diaphragm 17 is indicated by a motion arrow 21. By moving the pinhole diaphragm 17, it is possible to change the energy of the particles 3 passing through the energy filter 1. Accordingly, the energy of the particle beam 16 leaving the energy filter 1 can be varied. Such a change in the particle energy is necessary, for example, so that the depth of the Bragg peak in a target material (for example, in a tissue) can be varied. In addition or as an alternative, it is also possible to achieve such an energy variation by changing the strength of the magnetic field in the solenoid 12.

Moreover, the diffusion film 19 can be provided not only essentially at the "end" of the energy filter 1 (as is drawn in FIG. 1), but also already in front of the pinhole diaphragm 17. Practically speaking, there should be a certain distance (typically several centimeters) between the pinhole diaphragm 17 and an upstream diffusion film 19, so that the scatter caused by the diffusion film 19 actually has a smoothing effect on the energy selection.

Moreover, size-change arrows 22 are drawn in FIG. 1. They indicate that the size of the round hole 18 in the pinhole diaphragm 17 is configured variably. This can be done, for example, as a kind of an iris diaphragm or the like. By changing the size of the round hole 18 in the pinhole diaphragm 17, it is possible to increase or decrease the width of the filter curve (and thus the width of the interval of the energies that are allowed to pass through). In particular, this also makes it possible to keep the relative width of the energy interval essentially constant in case of a change in the energy level that is allowed to pass through. Such an adjustment possibility is typically desired with medical systems.

Moreover, it is also possible to provide a second pinhole diaphragm, especially in an area situated between the target film 7 and the rod-shaped absorber 15. In particular, it is also possible to provide an adjacent second pinhole diaphragm in front of and/or behind or else inside the solenoid coil 12. If two pinhole diaphragms are present, the particle fraction allowed to pass through the energy filter 1, and thus the intensity of the particles 3 leaving the energy filter 1, can be varied by means of a simultaneous size variation of both pinhole diaphragms (without the energy range filtered out by the energy filter 1 being essentially changed).

The output particle beam 16 generated and released by the particle beam source 2 can subsequently be applied in a treatment room in the generally known manner, especially to a patient in the treatment room.

Figure 2:
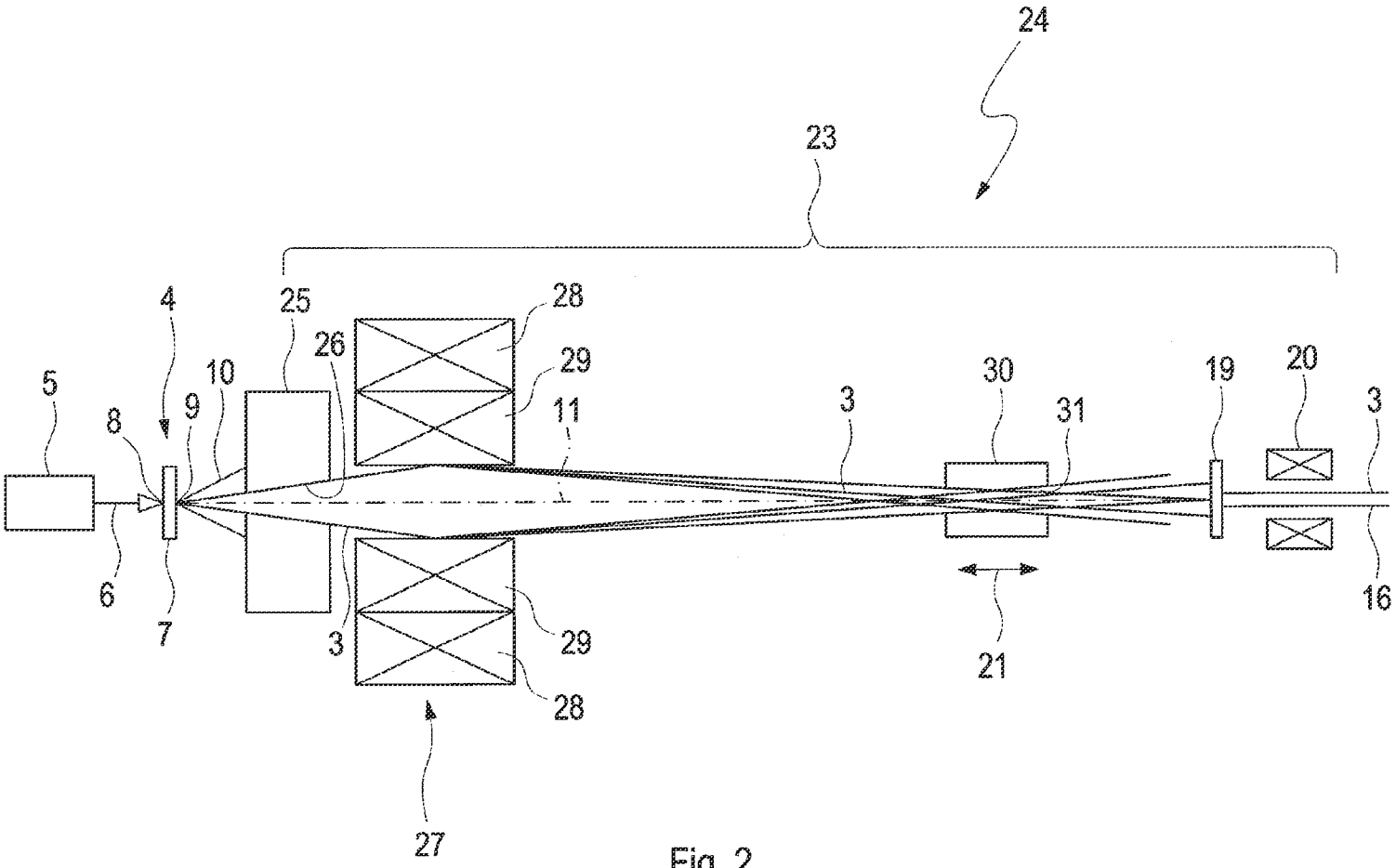
FIG. 2 shows a second embodiment of a particle beam source in a schematic view.

FIG. 2 shows a particle beam source 24 that has been modified as compared to the version in FIG. 1. The difference lies essentially in the different structure of the energy filter 23.

First of all, analogously to the particle beam source 2 shown in FIG. 1, the laser beam 6 generated by a laser 5 is directed at a target film 7, so as to generate a diverging particle beam bundle 10 having particles 3 of many different energies and output angles.

The diverging particle beam bundle 10 is first applied to a stopper block 25. This is a block made of a material that absorbs energy well (for example, lead) that has a frustoconical recess 26 in the middle relative to the center line 11. The recess is shaped in such a way as to prevent particle radiation 3 from striking the surfaces of the (switched-on) solenoid arrangement 27. As a result, on the one hand, no burden is placed on the solenoid arrangement 27, and on the other hand, the generation of secondary radiation (gamma radiation, electron radiation, neutron radiation and the like) is prevented. The frustoconical recess 26 is shaped in such a way that the tip of the cone would be in the punctiform accelerator area 9. Accordingly, the surface of the recess 26 runs parallel to the particle beams 3 immediately adjacent to the surface of the recess 26. In other words, the recess 26 has an oblique beam-optimized configuration. Particle beams 3 with a slightly smaller angle than the angle of the recess 26 pass the stopper block 25 without being hindered. However, particle beams 3 with a slightly larger angle pass completely through the thickness of the stopper block 25, and are thus sufficiently attenuated.

In the present embodiment of the particle filter 23, the solenoid arrangement 27 consists of a superconductive coil 28 and a normally conductive coil 29. Here, the two coils 28, 29 of the solenoid arrangement 27 are arranged concentrically with respect to each other. However, it would also be conceivable to have, for example, a serial arrangement in the direction of the center axis 11 of the energy filter 23. The superconductive solenoid 28 brings about a strong but constant magnetic field. However, with the normally conductive solenoid 29, an additional, especially time-variable, magnetic field can be superimposed on this magnetic field. As a result, the (energy-dependent) focus of particles 3 of a certain energy can be moved along the center axis 11 of the energy filter 23 by "electric measures". In particular, the energy filter properties of the energy filter 23 can be varied in this manner.

In the present embodiment of the energy filter 23, a diaphragm block 30 is provided. The diaphragm block 30 has a double frustoconical recess 31 in its interior. The recess 31 is shaped in such a way that it runs parallel to the particles 3 having the highest, still permissible (not attenuated), energy or the lowest, still permissible (not attenuated), energy. Accordingly, the surface of the recess 31 of the diaphragm block 30 has an oblique beam-optimized configuration. Here, too, as already explained above, the effect is that either no attenuation occurs, or else an attenuation occurs over the entire length of the diaphragm block 30.

As indicated by the motion arrow 21, also in the embodiment of the energy filter 23 shown here, the diaphragm block 30 can be moved parallel to the center axis 11. If applicable, it is also conceivable that the recess 31 could be variable (especially in terms of its size and/or shape).

The particles 3 leaving the diaphragm block 30 are conveyed to a diffusion film 19 (analogous to the energy filter 1 shown in FIG. 1), where they are processed slightly and blurred in terms of their energy ranges. Subsequently, the particles 3 are "rendered parallel" in a downstream solenoid 20 to form a parallel beam bundle 16.

Figure 3:
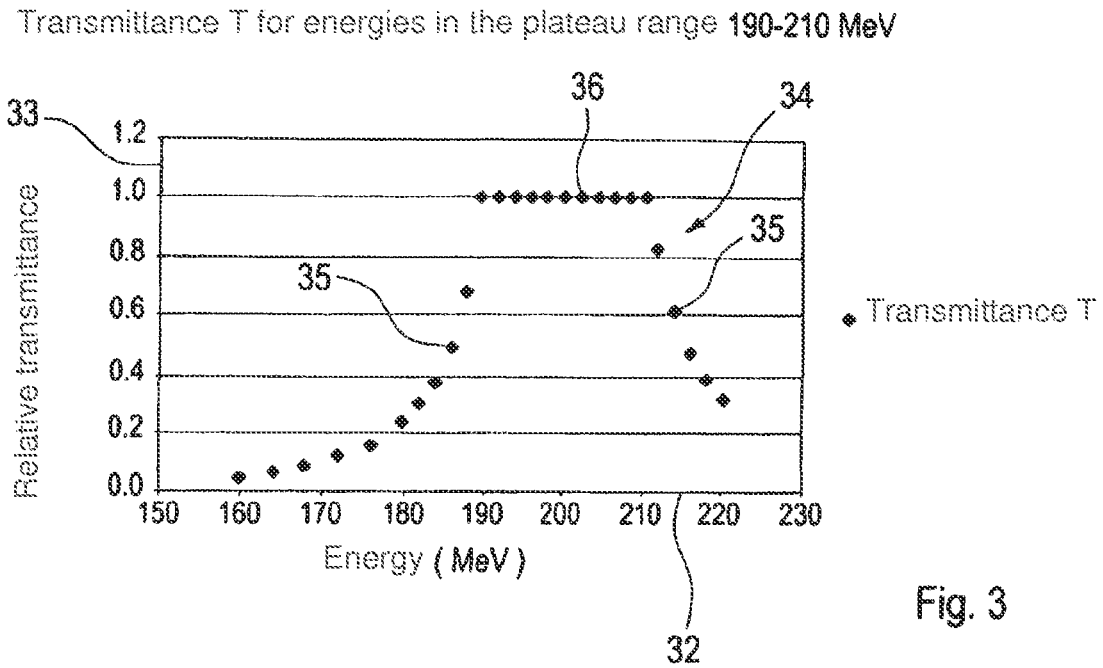
FIG. 3 shows a typical transmittance curve for the particle beam source shown in FIG. 2.

FIG. 3 shows a typical energy spectrum of an output beam 16. Here, the particle energy in MeV is plotted along the abscissa 32, and the relative transmittance is plotted along the ordinate 33. As can be seen, the filter curve 34 has flattened side flanks 35 (especially due to the permeability of the round hole 18 and due to the influence of the diffusion film 19) as well as a flat plateau 36.

For some applications, the flat plateau 36 of the filter curve 34 is undesired. Precisely during the treatment of a tumor by means of a raster scan application using a pencil-thin particle beam, it is desirable for the filter curve to have a Gaussian profile. After all, the superimposition of different Gaussian profiles once again results in a Gaussian profile, so that the calculation of the irradiation plan—and thus the subsequent actual irradiation—can be simpler and more precise.

In order for the filter curve 34 shown in FIG. 3 to be "rendered Gaussian", a diaphragm block 37 having a suitably configured passage cross section 38 can be used instead of a diaphragm block 30 having an essentially circular recess 31.

Figure 4:
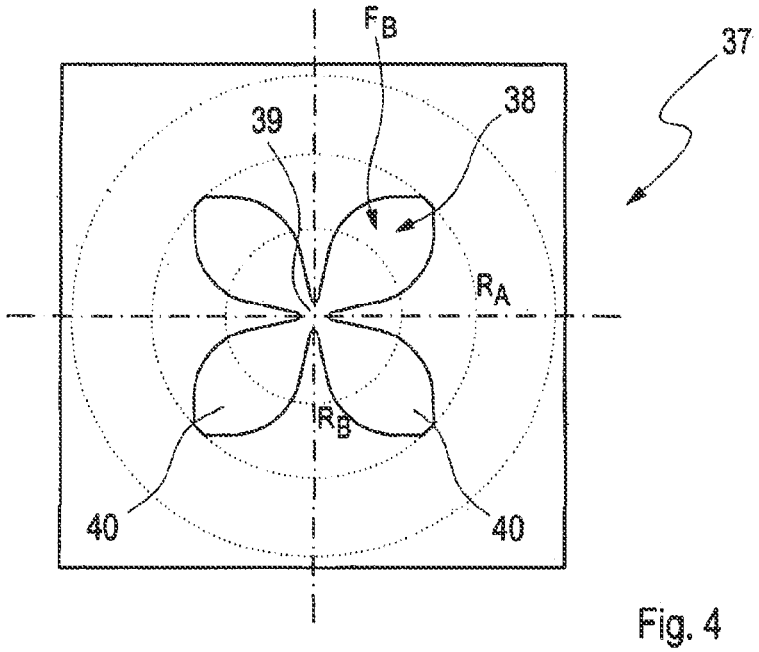
FIG. 4 shows a modified particle diaphragm for use in a particle beam source in a schematic top view from the front.

A possible embodiment of a diaphragm block 37 with a suitable recess 38 is shown in FIG. 4. The diaphragm block 37 is shown here in a schematic cross section. Here, the cross sectional plane is perpendicular to the center axis 11 of the energy filter. For example, the diaphragm block 37 can be used instead of the diaphragm block 30 of the energy filter 23 shown in FIG. 2.

As can be seen, the recess 38 has a central hole 39 in the middle. On the outer edge of this central hole 39, there are—here four—lobe-like widened sections 40 of the recess 38. Of course, it is also possible to use a different number of lobe-like widened sections 40. Here, the lobe-like widened sections 40 are each identical in shape; however, it is quite conceivable for the lobe-like widened sections 40 to each be configured differently.

Figure 5:
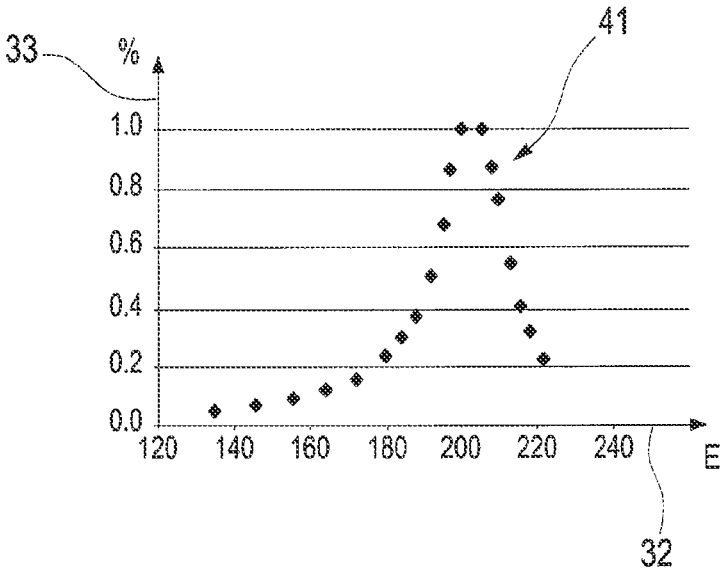
FIG. 5 shows a typical energy distribution curve when the particle diaphragm shown in FIG. 4 is used.

Due to the special shaping of the lobe-like widened sections 40, it is possible that, in terms of the energy, no sharp section edge occurs, but rather that different energies with different percentage values can pass through the diaphragm block 37. The recess shown in FIG. 4 is configured in such a way as to ultimately yield an approximately Gaussian configuration of the filter curve 41 (see FIG. 5).

When it comes to shaping the recess 38 (especially of the lobe-like widened sections 40), care should be taken to ensure that the relationship $T=F(RB)/(RB2\times\pi)$ applies to the relative transmittance of a particle group with respect to the energy having the associated radius Rb, whereby FB=F(RB) is the surface within the recess 38 that is not occupied by absorber material.

Moreover, the recess 38 is shaped in such a way as to once again yield a oblique beam-optimized surface for said recess 38. For cross sections that are in front of or behind the cross sectional plane shown in FIG. 4 in the direction of the center axis 11, the recess 38 can be configured correspondingly larger or smaller.

Figure 6:
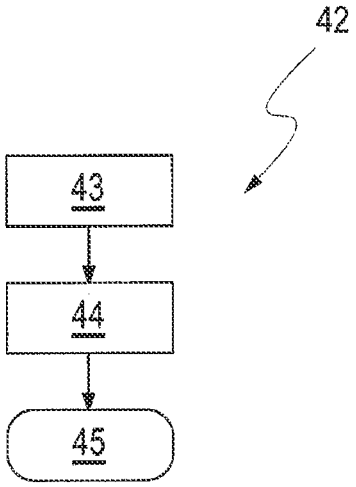
FIG. 6 shows a possible embodiment for carrying out an energy selection method.

Finally, a method 42 for the energy-dependent filtering of particle radiation 3 of charged particles is shown in FIG. 6 in simplified form. For this purpose, in a first method step 43, the electrically charged particles 3 generated, for example, by a high-energy laser 5 in conjunction with a target 7 is focused on a suitable focal point 14 by means of a suitable device (for example, one or more solenoids 12, 27, 28, 29). In a second method step 44, the particles 3 focused on the focal point 14 are separated from the other particles 3 (whereby preferably the other particles 3 are attenuated). Thus, at the end 45 of the method 42 (whereby the method 42 can, of course, still be modified), one obtains a focused particle beam 16 with particles 3 having a suitable energy level.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

LIST OF REFERENCE NUMERALS

1 energy filter
2 particle beam source
3 particles
4 accelerator stage
5 laser
6 laser beam
7 target film
8 impact spot
9 accelerator area
10 diverging beam bundle
11 center axis
12 solenoid coil
13 focal point (wrong energy)
14 focal point (right energy)
15 rod-shaped absorber
16 output particle beam
17 pinhole diaphragm
18 round hole
19 diffusion film
20 solenoid
21 motion arrow
22 size-change arrow
23 energy filter
24 particle beam source
25 stopper block
26 recess
27 solenoid arrangement
28 superconductive solenoid
29 normally conductive solenoid
30 diaphragm block
31 recess
32 abscissa
33 ordinate
34 filter curve
35 flank
36 plateau
37 diaphragm block
38 recess
39 central hole
40 widened sections
41 filter curve
42 method for the energy-dependent filtering of radiation
43 focusing on a focal point
44 separation of particles

The invention claimed is:

1. An energy filter device for particle radiation comprising:

an energy dependent focusing device that includes a magnetic field generating device comprising a single magnet configured to produce a chromatic filtering effect to focus particles of the particle radiation to respective different focal points depending on respective energies of the particles; and a beam separating device disposed downstream of the focusing device and configured to allow a certain energy fraction to pass through and to attenuate the remaining energy fraction, wherein the different focal points are located along an optical axis of the energy dependent focusing device.

2. The energy filter device recited in claim 1, wherein the energy filter is configured for radiation including charged particles.

3. The energy filter device recited in claim 1, wherein the energy filter device includes precisely one or precisely two beam separating devices.

4. The energy filter device recited in claim 1, wherein the beam separating device includes at least one of a variable beam separating device or at least one movably arranged beam separating device.

5. The energy lifter device recited in claim 1, wherein the single magnet is a solenoid.

6. The energy filter device recited in claim 1, wherein the focusing device includes a plurality of focusing devices that at least in certain areas have a focusing effect in different directions.

7. The energy filter device recited in claim 1, wherein the energy-dependence of the focusing device is expressed as a movement of the focal point at least in certain areas.

8. The energy filter device recited in claim 1, wherein the beam separating device is configured in certain sections as an absorber device.

9. The energy filter device recited in claim 1, wherein the beam separating device is at least partially configured as at least one of a diaphragm device or an axial absorber device, the at least one of a diaphragm device or axial absorber device being provided with oblique beam-optimized surfaces or a frustoconical surface.

10. The energy filter device recited in claim 1, wherein the beam separating device is configured as a direction-dependent beam separating device.

11. The energy filter device recited in claim 10, wherein the beam separating device is configured as an angular direction-dependent beam separating device.

12. The energy filter device recited in claim 1, further comprising an upstream beam separating device that brings about a beam separation in terms of the spatial angle range of the radiation entering the energy filter device.

13. The energy filter device recited in claim 1, wherein the beam separating device is configured as a diffusion film device.

14. The energy filter device recited in claim 1, further comprising a downstream focusing device for the radiation exiting from the energy filter device.

15. The energy filter device recited in claim 5, further comprising:

a second solenoid configured to produce a chromatic filtering effect to focus particles of the particle radiation to respective different focal points depending on respective energies of the particles, wherein the solenoid and the second solenoid are arranged at least one of concentrically or serially.

16. The energy filter device recited in claim 15, wherein the solenoid brings about a constant magnetic field, and wherein the second solenoid brings about a time-variable magnetic field that is superimposed on the constant magnetic field.

17. A particle radiation, source, comprising:

a laser target film particle accelerator configured to generate particle radiation; and at least one energy filter device including:

an energy dependent focusing device that includes a magnetic field generating device comprising a single magnet configured to produce a chromatic filtering effect to focus particles of the particle radiation to respective different focal points depending on respective energies of the particles; and a beam separating device disposed downstream of the focusing device and configured to allow a certain energy fraction to pass through and to attenuate the remaining energy fraction, wherein the different focal points are located along, an optical axis of the energy dependent focusing device.

18. The particle radiation source recited in claim 17, wherein the laser target film particle accelerator includes:

a laser configured to emit a laser beam; and a target film, wherein the target film has a radiation impact side disposed proximal to the laser and an acceleration area side disposed distal to the laser, and wherein the laser beam is directed at the target film so as to strike the radiation impact side of the target film in order to cause a diverging beam bundle of particle radiation to be emitted from the acceleration area side of the target film.

19. A method for the energy-dependent filtering of particle radiation, the method comprising:

splitting the radiation using an energy-dependent focusing device that includes a magnetic field generating device comprising a single magnet configured to produce a chromatic filtering effect to focus particles of the particle radiation to respective different focal points depending on respective energies of the particles; and after splitting the radiation, separating radiation having a desired energy using a beam separating device disposed downstream of the focusing device and configured to allow a certain energy fraction to pass through and to attenuate the remaining energy fraction, wherein the different focal points are located along an optical axis of the energy dependent focusing device.

20. The method recited in claim 19, wherein the particle radiation includes charged particles.

* * * * *